US006499735B2

(12) United States Patent
Zeltner

(10) Patent No.: US 6,499,735 B2
(45) Date of Patent: Dec. 31, 2002

(54) METHOD AND DEVICE FOR SEPARATING AND TRANSPORTING SHEETS OF PAPER

(75) Inventor: Jürgen Zeltner, Hirschberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/741,309

(22) Filed: Dec. 18, 2000

(65) Prior Publication Data

US 2001/0004143 A1 Jun. 21, 2001

(30) Foreign Application Priority Data

Dec. 17, 1999 (DE) ..... 199 61 364

(51) Int. Cl.[7] ..... B65H 5/08
(52) U.S. Cl. ..... 271/14; 271/93; 271/107
(58) Field of Search ..... 271/5, 11, 14, 271/93, 182, 187

(56) References Cited

U.S. PATENT DOCUMENTS 2,183,077 A * 12/1939 Kast ..... 271/11
3,809,389 A * 5/1974 Wirz ..... 271/93
4,106,765 A * 8/1978 Britt et al. ..... 271/93
5,542,658 A * 8/1996 Wirz et al. ..... 271/107
5,738,347 A * 4/1998 Tognino ..... 271/93
5,803,447 A * 9/1998 Singer et al. ..... 271/11

FOREIGN PATENT DOCUMENTS

DE 43 24 552 A1 1/1995
DE 295 10 214 U1 10/1995
DE 195 11 296 C2 10/1996

* cited by examiner

*Primary Examiner*—H. Grant Skaggs
(74) *Attorney, Agent, or Firm*—Laurence A. Greenberg; Werner H. Stemer; Ralph E. Locher

(57) ABSTRACT

A method for separating a respective sheet from a sheet pile and transporting it to a sheet processing machine, wherein the respective sheet is lifted by at least one lifting suction device to a transfer level lying above a suction air intake level, and the respective sheet is taken over by at least one forwarding suction device at the transfer level, includes thereafter transporting the respective sheet by the forwarding suction device on the transfer level in a direction towards the sheet processing machine, and after transferring the sheet from the lifting suction device to the forwarding suction device, lifting the lifting suction device to an elevation level above the transfer level; a device for performing the method; and rotary printing machine and method of operation including the foregoing.

8 Claims, 3 Drawing Sheets

1
2
3
4
6
7
8
9
10
11
12
13
14
16
17
18
19
21
22;23
24

METHOD AND DEVICE FOR SEPARATING AND TRANSPORTING SHEETS OF PAPER

BACKGROUND OF THE INVENTION

Field of the Invention

The invention relates to a method and device for separating sheets of paper from a sheet pile with the aid of at least one lifting suction device and for transporting the sheets to a sheet processing machine with the aid of at least one forwarding or pull suction device.

The published German Patent Document DE 43 24 552 A1 teaches the use of a pneumatically controlled lifting suction device and a pneumatically controlled forwarding or pull suction device. In this reference, the lifting suction device separates the sheet from a sheet pile by lifting the sheet to a transfer level. The forwarding or pull suction device takes the sheet from a return level to a lower-lying transport level during a return motion. To prevent tensions in the sheet, the lifting suction device must simultaneously release the sheet; i.e., only a very short time window is provided for releasing the sheet. Particularly in the case of changing machine speeds, the air inertia of pneumatic systems can lead to defective sheet transfers from the lifting suction device to the pull or forwarding suction device, because no assurance can be offered that the lifting suction device would let the sheet go precisely when the forwarding or pull suction device picks it up.

SUMMARY OF THE INVENTION

It is accordingly an object of the invention to provide a method and device for separating and transporting sheets whereby sheet transfer from a lifting suction device to a pull or forwarding suction device is improved over the prior art methods and devices.

With the foregoing and other objects in view, there is provided, in accordance with the invention, a method for separating a respective sheet from a sheet pile and transporting it to a sheet processing machine, wherein the respective sheet is lifted by at least one lifting suction device to a transfer level lying above a suction air intake level, and the respective sheet is taken over by at least one forwarding suction device at the transfer level, which comprises thereafter transporting the respective sheet by the forwarding suction device on the transfer level in a direction towards the sheet processing machine, and after transferring the sheet from the lifting suction device to the forwarding suction device, lifting the lifting suction device to an elevation level above the transfer level.

In accordance with another mode, the method of the invention includes, in a return motion, moving the forwarding suction device from one terminal location to another terminal location on a return level situated above the transfer level.

In accordance with a further mode of the method, the return level is the elevation level above the transfer level.

In accordance with an added mode, the method invention includes lowering the lifting suction device from the elevation level to the suction air intake level after transporting the respective sheet away.

In accordance with an additional aspect of the invention, there is provided a device for performing a method of separating and transporting a sheet from a sheet pile, comprising a lifting suction device for separating the sheet from a sheet pile, a forwarding suction device for transporting the sheet in a direction towards a sheet processing machine, and a cam mechanism for moving the lifting suction device to three different elevation levels.

In accordance with another feature of the invention, wherein one of the elevation levels is a suction air intake level, and the suction air intake level of the lifting suction device is adjustable.

In accordance with a further feature of the invention, the forwarding suction device is pneumatically adjustable to two different elevation levels of the three different elevation levels.

In accordance with yet another aspect of the invention, there is provided a sheet-fed rotary printing machine having a device for performing a method of separating and transporting a sheet from a sheet pile, the device comprising a lifting suction device for separating the sheet from a sheet pile, a forwarding suction device for transporting the sheet in a direction towards a printing unit, and a cam mechanism for moving the lifting suction device to three different elevation levels.

In accordance with a concomitant aspect of the invention, there is provided, in a method of operating a sheet-fed rotary printing press, a method for separating a respective sheet from a sheet pile and transporting it to a printing unit, wherein the respective sheet is lifted by at least one lifting suction device to a transfer level lying above a suction air intake level, and the respective sheet is taken over by at least one forwarding suction device at the transfer level, which comprises thereafter transporting the respective sheet by the forwarding suction device on the transfer level in a direction towards the printing unit, and after transferring the sheet from the lifting suction device to the forwarding suction device, lifting the lifting suction device to an elevation level above the transfer level.

The advantage of the inventive method is namely that a larger time window is provided for the sheet transfer from the lifting suction device to the forwarding suction device, while at the same time tension in the sheet and scratches or abrasions of the sheet by the lifting suction device during transport of the sheet by the forwarding suction device are prevented.

In addition, during its return, the forwarding suction device does not contact the sheet which has been lifted with the aid of the lifting suction device, either.

The advantage of the device according to the invention lies particularly in the combination of a mechanically elevation or height-controlled lifting suction device and a pneumatically elevation or height-controlled forwarding suction device.

This measure makes it possible to construct a sufficiently long time window for transferring the sheet and, as a result, the exact sheet transfer does not depend upon the inertia of the air control.

Other features which are considered as characteristic for the invention are set forth in the appended claims.

Although the invention is illustrated and described herein as embodied in a method and a device for separating and transporting sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
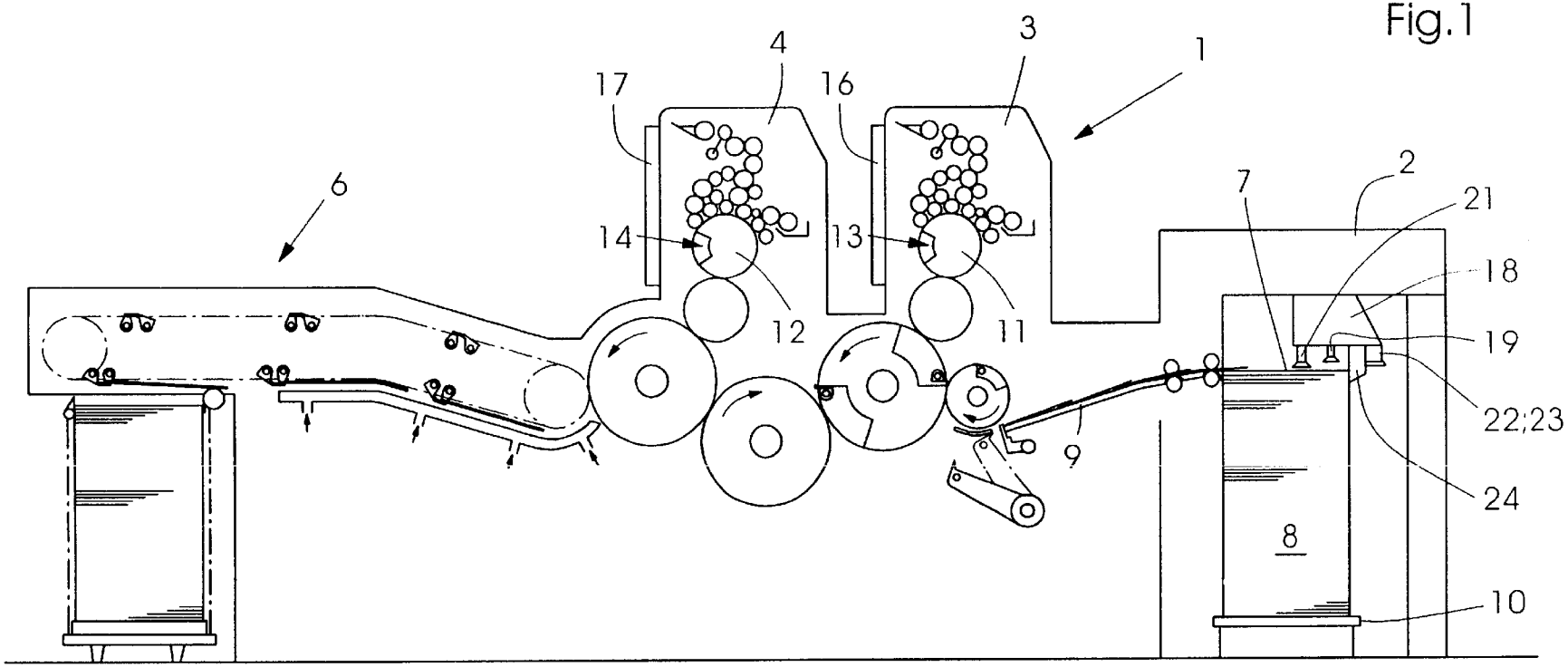
FIG. 1 is a diagrammatic side elevational view of a sheet-fed rotary printing machine incorporating the device for separating and transporting sheets in accordance with the invention.

Referring now to the drawings and, first, particularly to FIG. 1 thereof, there is shown therein a rotary printing machine, for example, a printing machine 1 for processing sheets 7, including a sheet feeder 2, at least one printing unit 3 and 4, respectively, and a delivery 6. The sheets 7 are drawn from a sheet pile 8 and fed to the printing units 3 and 4 separately, i.e., singly, or in an overlapping or shingle stream feed via a feed table 9.

The printing units 3 and 4, respectively, include a plate cylinder 11, 12 disposed in a conventional manner. The plate cylinders 11 and 12, respectively, include a device 13, 14 for securing flexible printing plates. Moreover, a respective device 16, 17 for semi-automatic or fully automatic printing plate exchange is allocated to each plate cylinder 11, 12.

The sheet pile 8 rests on a controllingly liftable pile or stack plate 10. A respective sheet 7 is withdrawn from the top of the sheet pile 8 with the aid of a so-called suction head 18, which includes, among other things, a number of lifting and forwarding suckers 19 and 21 for separating or singling the sheets 7. Furthermore, blowing or blast mechanisms 22 are provided for the purpose of loosening the top sheets, and key elements 23 are provided for guiding the sheet pile 8. A plurality of lateral and rear stops 24 are provided for orienting the sheet pile 8, specifically the top sheet 7 thereof. The forwarding sucker 21 is constructed as a two-stage pneumatically activatable suction gripper which is movable linearly between a first terminal position A and a second terminal position B (note FIGS. 2 to 5) with the aid of a non-illustrated drive.

Moreover, as shown in FIGS. 2 to 5, the forwarding suction device 21 is provided with a piston/cylinder unit 26 and is connected to a vacuum source 27. A suction plate 28 of the forwarding suction device 21 can be moved by this measure between a first elevation level I and a second elevation level II. A third elevation level III is formed by the top sheet 7 of the sheet pile 8.

In order to separate the sheet 7 from the sheet pile 8, a suction plate 29 of the lifting suction device 19 is adjustingly guided vertically to the three elevation levels I, II and III. Of course, adjusting mechanisms can be provided for adjusting to different suction air intake levels III depending upon the sheet material being processed. To initiate the lifting motion, the lifting suction device 19 includes a cam mechanism 33, which is connected to a control cam 32 via a control roller 31. The control cam 32 is driven in phase with the sheet processing machine. In this way, driving can occur directly via the gear unit of the sheet processing machine or with the aid of a correspondingly controllable electric motor.

Figure 2:
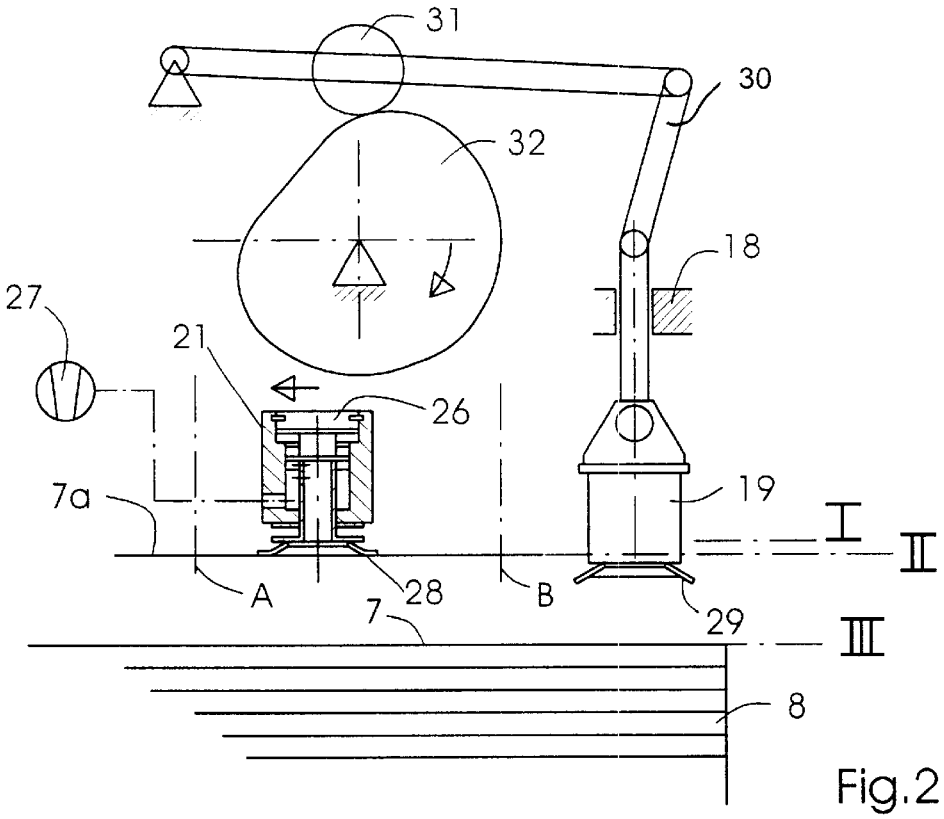
FIGS. 2 to 5 are similar enlarged fragmentary views of FIG. 1 showing, in different operating phases, lifting and forwarding suction devices of the device for separating and transporting sheets in accordance with the invention.

In the operating method according to the invention, the lifting suction device 19 is lowered to the suction level corresponding to the elevation level III with the aid of the cam mechanism 30 (FIG. 2). The uppermost sheet 7 of the sheet pile 8 is grasped by suction and lifted to the transfer/transport level corresponding to the elevation level II (FIG. 3).

Figure 3:
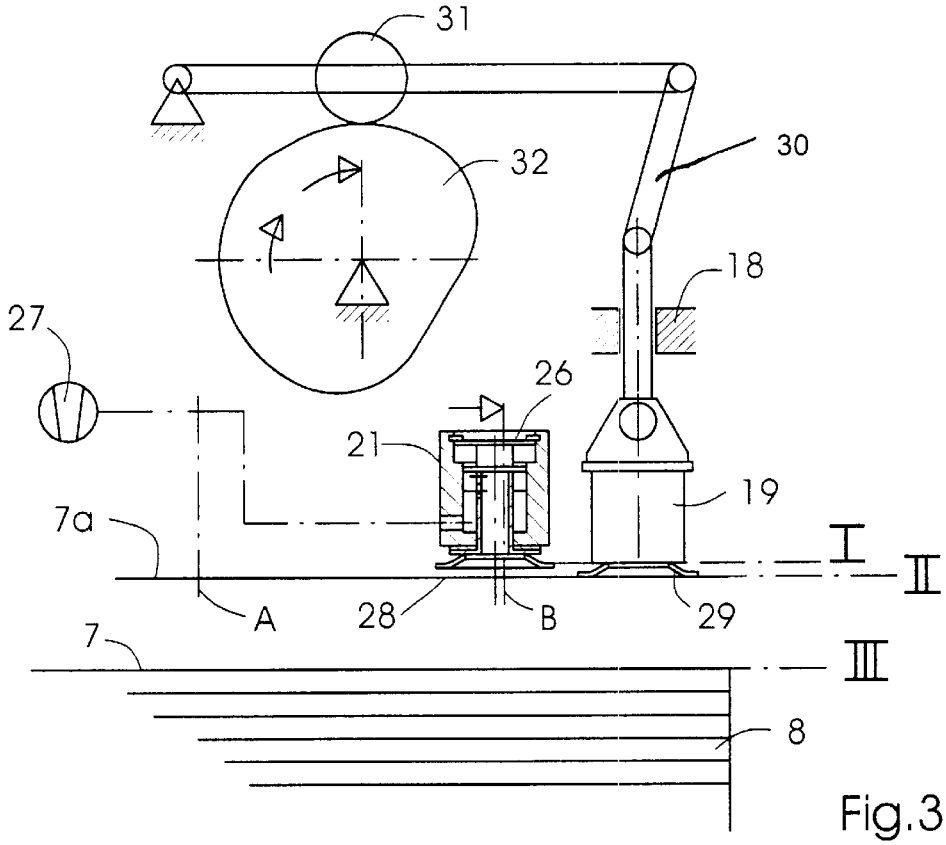

During the separation of the sheet 7 from the sheet pile 8, the forwarding suction device 21 and the suction plate 28, respectively, are moved from the first terminal position A back to the second terminal position B on elevation level I, which lies above the transport level II, so that the forwarding suction device 21 does not contact an end of the sheet 7*a* being transported away and the subsequently lifted sheet 7 (FIG. 3).

Figure 4:
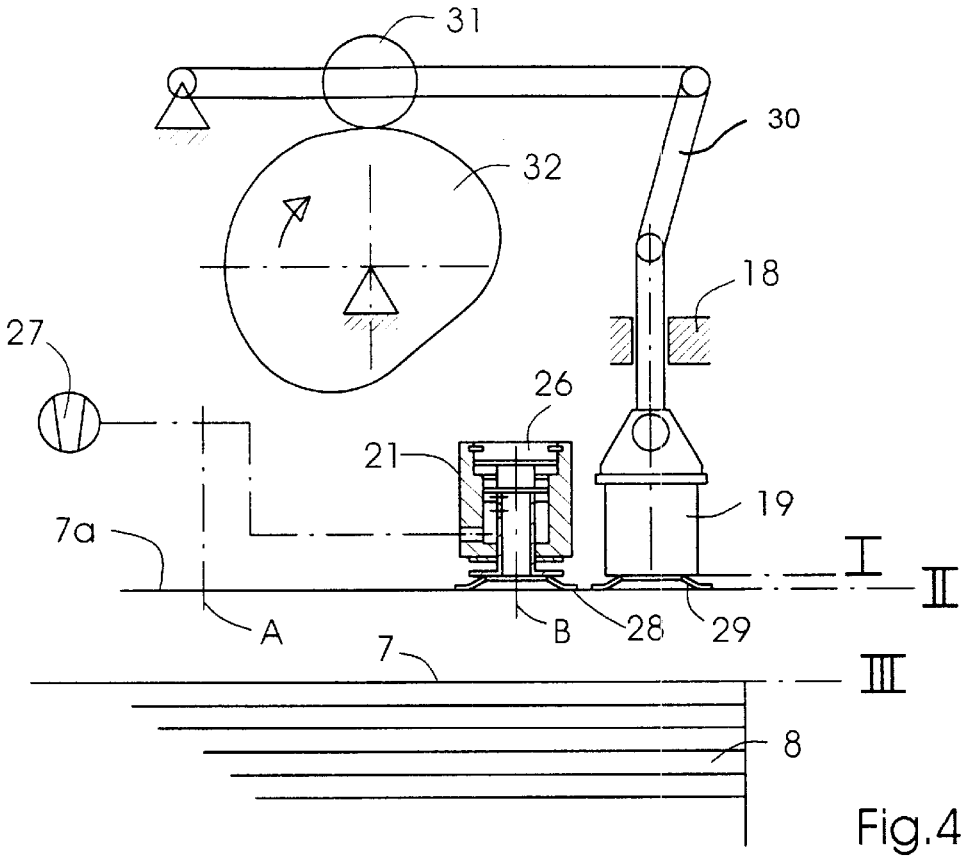

In the terminal position B, the suction plate 28 of the forwarding suction device 21 is lowered to the transfer/transport level II in order to take over from the lifting suction device 19 the new sheet 7*a* that has been separated from the sheet pile 8 (FIG. 4).

Figure 5:
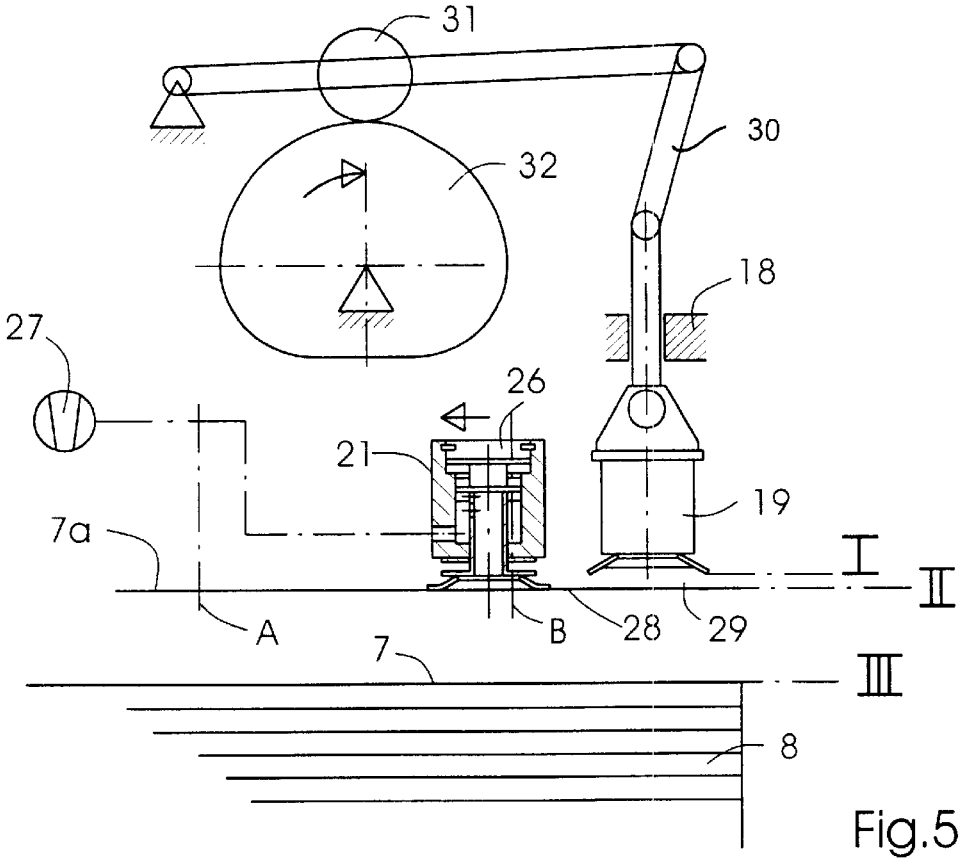

Following the successful grasping of the sheet 7*a* by the suction from the forwarding suction device 21 and the suction plate 28, respectively, the lifting suction device 19 is aerated, and the suction plate 29 releases the sheet 7*a*. Next, the lifting suction device 19 and the suction plate 29 are raised from the transfer level II approximately to the return level corresponding to elevation level I, so that the suction plate 29 does not come into contact with the surface of the sheet 7*a* during the largely simultaneous transport of the sheet 7*a* by the forwarding suction device 21 (FIG. 5).

After the end of the sheet 7, 7*a* leaves the region of the lifting suction device, this device is lowered to the sheet pile 8 so as to pick up the next sheet 7 (FIG. 2).

I claim:

1. A method for separating a respective sheet from a sheet pile and transporting it to a sheet processing machine, which comprises lifting the respective sheet by at least one lifting suction device to a transfer level lying above a suction air intake level, taking the respective sheet over by at least one forwarding suction device at the transfer level, thereafter transporting the respective sheet by the forwarding suction device on the transfer level in a direction towards the sheet processing machine, and after transferring the sheet from the lifting suction device to the forwarding suction device, releasing the sheet from the lifting suction device prior to lifting the lifting suction device to an elevation level above the transfer level.

2. The method according to claim 1, which includes, in a return motion, moving the forwarding suction device from one terminal location to another terminal location on a return level situated above the transfer level.

3. The method according to claim 2, wherein the return level is the elevation level above the transfer level.

4. The method according to claim 3, which includes lowering the lifting suction device from the elevation level to the suction air intake level after transporting the respective sheet away.

5. A device for performing a method of separating and transporting a sheet from a sheet pile, comprising a lifting suction device for separating the sheet from a sheet pile, a forwarding suction device for transporting the sheet in a direction towards a sheet processing machine, and a cam mechanism for moving said lifting suction device to three different elevation levels, one of said three different elevation levels being a suction air intake level, said suction air intake level of said lifting suction device being adjustable, and said lifting suction device being configured to release the sheet prior to being lifted to a highest one of said three different elevation levels.

6. The device according to claim 5, wherein said forwarding suction device is pneumatically adjustable to two different elevation levels of said three different elevation levels.

7. A sheet-fed rotary printing machine having a device for performing a method of separating and transporting a sheet from a sheet pile, the device comprising a lifting suction device for separating the sheet from a sheet pile, a forwarding suction device for transporting the sheet in a direction towards a printing unit, and a cam mechanism for moving said lifting suction device to three different elevation levels, one of said three different elevation levels being a suction air intake level, said suction air intake level of said lifting suction device being adjustable, and said lifting suction device being configured to release the sheet prior to being lifted to a highest one of said three different elevation levels.

8. In a method of operating a sheet-fed rotary printing press, a method for separating a respective sheet from a sheet pile and transporting it to a printing unit, which comprises lifting the respective sheet by at least one lifting suction device to a transfer level lying above a suction air intake level, taking the respective sheet over by at least one forwarding suction device at the transfer level, thereafter transporting the respective sheet by the forwarding suction device on the transfer level in a direction towards the printing unit, and after transferring the sheet from the lifting suction device to the forwarding suction device, releasing the sheet from the lifting suction device prior to lifting the lifting suction device to an elevation level above the transfer level.

* * * * *